US006259883B1

(12) United States Patent
Tsunoda et al.

(10) Patent No.: US 6,259,883 B1
(45) Date of Patent: Jul. 10, 2001

(54) IMAGING FORMING APPARATUS HAVING A TONER EXHAUSTING DEVICE

(75) Inventors: Hiroshi Tsunoda; Yuichiro Suzuki; Yoshitaka Fujinuma; Masayuki Ainoya, all of Ibaraki (JP)

(73) Assignee: Hitachi Koki Co., Ltd., Tokyo (JP)

( * ) Notice: Subject to any disclaimer, the term of this patent is extended or adjusted under 35 U.S.C. 154(b) by 0 days.

(21) Appl. No.: 09/549,591

(22) Filed: Apr. 14, 2000

(30) Foreign Application Priority Data

Apr. 16, 1999 (JP) ..... 11-109127

(51) Int. Cl.[7] ..... G03G 21/00; G03G 15/08
(52) U.S. Cl. ..... 399/359; 399/120
(58) Field of Search ..... 15/256.5, 256.51; 399/119, 120, 123, 257, 343, 358, 359, 360

(56) References Cited

U.S. PATENT DOCUMENTS 5,493,382 * 2/1996 Takagaki et al. ..... 399/257
5,933,690 * 8/1999 Sugimoto et al. ..... 399/257
6,014,541 * 1/2000 Kato et al. ..... 399/358

FOREIGN PATENT DOCUMENTS 9-44049 * 9/1997 (JP) .

* cited by examiner

*Primary Examiner*—Arthur T. Grimley
*Assistant Examiner*—Hoang Ngo
(74) *Attorney, Agent, or Firm*—Sughrue, Mion, Zinn, Macpeak & Seas, PLLC

(57) ABSTRACT

An image forming apparatus includes a developing unit having a photoreceptor, for making an electrostatic latent image on a surface of the photoreceptor visible as a toner image. A toner hopper stores toner to be supplied to the developing unit and a cleaning device removes and recovers the toner remaining on the surface of the photoreceptor after the toner image has been transferred onto a recording material. A toner transporting passage is connected between the cleaning device and the toner hopper, through which the toner recovered by the cleaning device is returned to the toner hopper. A toner exhausting port is disposed at a part of the toner transporting passage, from which the toner being returned from the cleaning device side is exhausted outside the toner transporting passage. An opening and closing member selectively opens or closes the toner exhausting port, wherein an inner diameter of the toner exhausting port is made larger than that of the toner transporting passage.

7 Claims, 3 Drawing Sheets

IMAGING FORMING APPARATUS HAVING A TONER EXHAUSTING DEVICE

BACKGROUND OF THE INVENTION

1. Field of the Invention

The present invention relates to an image forming apparatus, and particularly to the image forming apparatus having such a function that reuse and disuse of toner recovered by a cleaning device are selectively performed.

2. Description of the Related Art

JP-A-9-44049, for example, discloses an image forming apparatus, which comprises a developing unit which makes an electrostatic latent image formed on a surface of a photoreceptor visible as a toner image; a toner hopper for storing toner to be supplied to said developing unit; a cleaning device which removes and recovers the toner remained on the surface of the photoreceptor after the toner image has been transferred onto recording material; a toner transporting passage connected between the cleaning device and the toner hopper, through which the toner recovered by the cleaning device is returned to the toner hopper; a toner exhausting port disposed at a part of the toner transporting passage, from which the toner being returned from the cleaning device side is exhausted outside the toner transporting passage; and an opening and closing member which selectively opens or closes the toner exhausting port.

In the toner transporting passage of this type of the image forming apparatus, there has been a problem that when the opening and closing member is opened to open the toner exhausting port, the toner is not satisfactorily exhausted from the toner exhausting port, so that the toner gets over the toner exhausting port and the waste toner is returned from the toner exhausting port to the toner hopper. As a result, there has been also a problem that the waste toner is reused thereby to deteriorate printing quality.

SUMMARY OF THE INVENTION

An object of the present invention is to provide an image forming apparatus capable of reliably exhausting waste toner from a toner exhausting port without returning the waste toner from the toner exhausting port to a toner hopper.

In order to achieve the above object, there is provided an image forming device which comprises: a developing unit which makes an electrostatic latent image formed on a surface of a photoreceptor visible as a toner image; a toner hopper for storing toner to be supplied to the developing unit; a cleaning device which removes and recovers the toner remaining on the surface of the photoreceptor after the toner image has been transferred onto recording material; a toner transporting passage connected between the cleaning device and the toner hopper, through which the toner recovered by the cleaning device is returned to the toner hopper; a toner exhausting port disposed at a part of the toner transporting passage, from which the toner being returned from the cleaning device side is exhausted outside the toner transporting passage; and an opening and closing member which selectively opens or closes the toner exhausting port, wherein an inner diameter of the toner exhausting port is made larger than that of the toner transporting passage.

DETAILED DESCRIPTION OF THE PRESENT INVENTION

The present invention will be described in detail with reference to the accompanying drawings.

Figure 1:
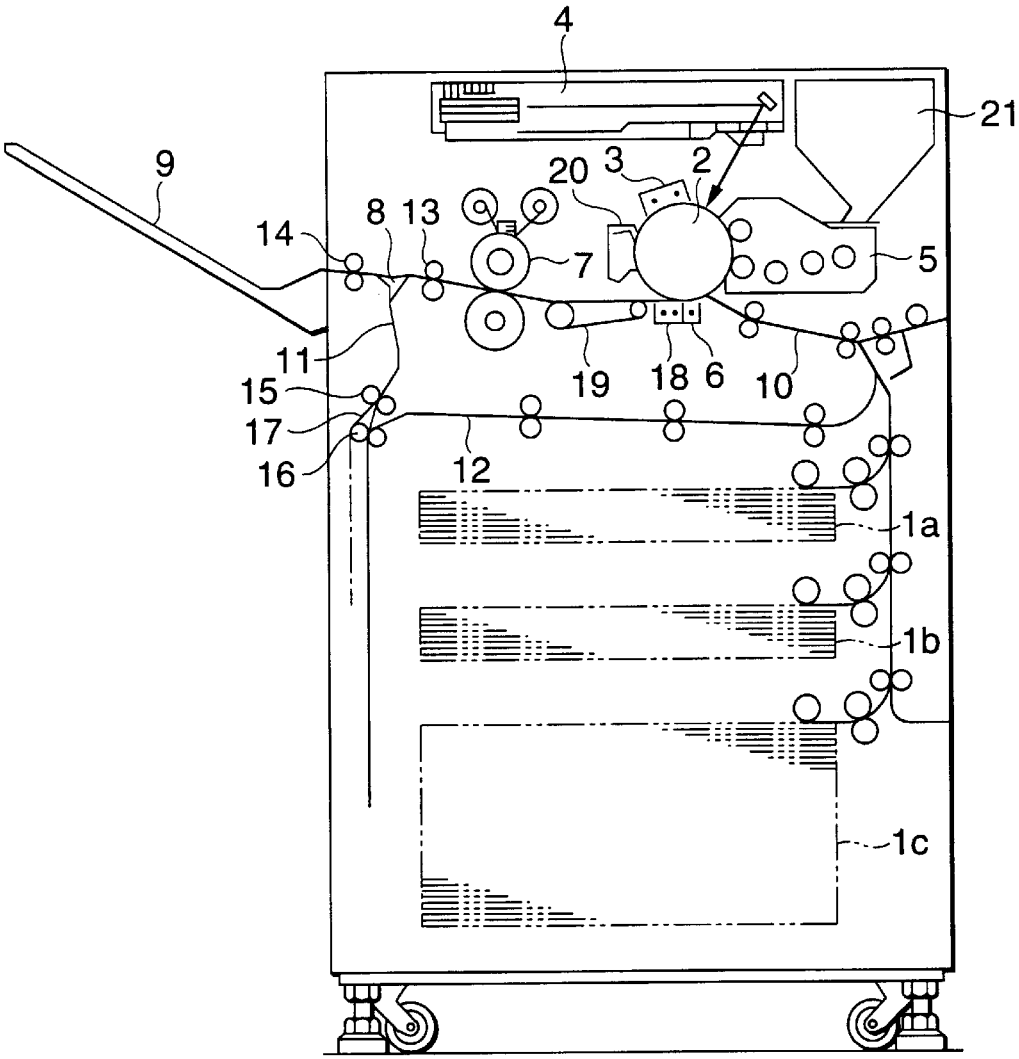
FIG. 1 is a whole constitutional view of an image forming apparatus.

Referring to FIG. 1, the whole constitution of a laser printer of the present invention will be described. In FIG. 1, reference numerals 1*a,* 1*b* and 1*c* are paper supplying sections in which sheets are stored. Reference numeral 2 is a photosensitive drum, which starts rotating in accordance with signals from a controller (not shown). As the photosensitive drum 2 starts rotating, a surface of the photosensitive drum 2 is uniformly charged by a corona charger 3. On the charged photosensitive drum 2, an electrostatic latent image is formed by a scanning beam from an exposing device 4. When the electrostatic latent image reaches a position of a developing unit 5, it is developed by toner and made visible on the photosensitive drum 2 as a toner image.

On the other hand, from the paper supplying section 1*a,* 1*b* or 1*c,* a sheet selected from the paper supplying section 1*a,* 1*b* or 1*c* is fed out at such a timing that the toner image formed on the photosensitive drum 2 faces the sheet at a position of a transferring unit 6, and then the toner image is transferred onto the sheet. Reference numeral 7 is a fixing device, by which the toner image transferred on the sheet is fixed. Further, after the toner image has been transferred onto the sheet, the toner remained on the surface of the photosensitive drum 2 is removed from the photosensitive drum 2 by a cleaning device 20.

Reference numeral 8 is a flap for controlling a direction of a sheet to be transported. Reference numeral 9 is a paper exhausting tray serving as a paper exhausting section, on which the sheets on which the image has been already formed are stacked. Reference numeral 10 is a paper feeding passage which communicates with the paper supplying sections 1*a,* 1*b* and 1*c;* the image forming means 2, 3, 4, 5, 6 and 7; and the paper exhausting tray 9. Reference numeral 11 is a paper drawn-in passage, which diverges from the paper feeding passage 10 downstream in the paper transporting direction with respect to the image forming means, and selectively draws the sheet fed out from the fixing device 7 therein by switching control of the flap 8. Reference numeral 12 is a return passage which diverges from the paper drawn-in passage 11, and of which an end joins the paper feeding passage 10 upstream in the paper transporting direction with respect to the image forming means.

Accordingly, in case that printing is performed on both sides of the sheet, the sheet fed out from the fixing device 7 is drawn in the paper drawn-in passage 11 and then this sheet is fed out to the return passage 12, whereby the sheet on which recording has been performed on one side is again fed out to the image forming means, so that two-sided printing is executed. In FIG. 1, reference numerals 13 and 14 are a pair of feed rollers, respectively, and their pairs are provided before and after the flap 8; 15 and 16 are respectively a pair of feed rollers, in which forward rotation and backward rotation can be switched, and their pairs are provided on the paper drawn-in passage 11; 17 is a flap for switching that the sheet drawn in the drawn-in passage 11 is fed out to the return passage 12 and that the sheet drawn in the drawn-in passage 11 is returned to the paper feeding passage 10 thereby to be exhausted to the paper exhausting tray 9; 18 is a stripping unit for stripping off the sheet that has passed through the transfer unit 6 from the photosensitive drum 2; and 19 is a feed belt for feeding the sheet to the fixing device 7.

Figure 2:
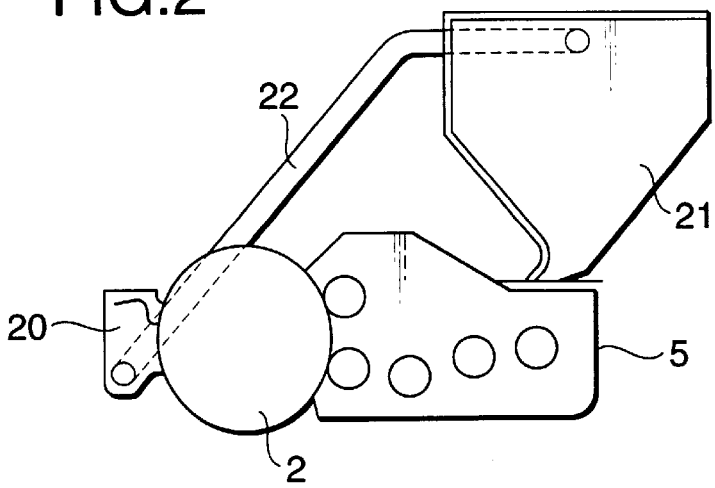
FIG. 2 is a schematic constitutional view showing the relationship among a cleaning device, a toner transporting passage and a toner hopper.
Figure 5:
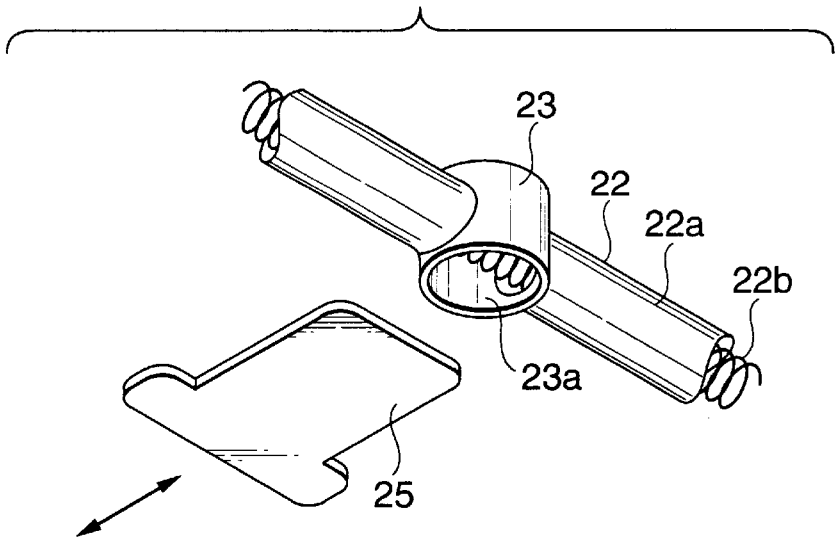
FIG. 5 is a schematic perspective view in which the vicinity of the toner exhausting section is viewed from the lower portion.
Figure 6:
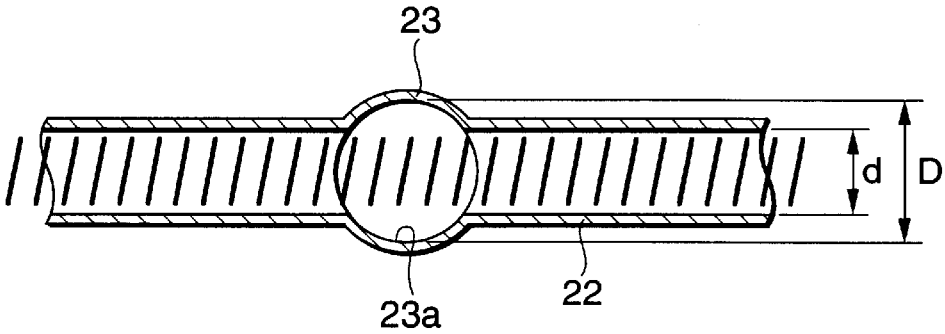
FIG. 6 is a horizontal sectional view of the toner transporting passage including the toner exhausting section.
Figure 7:
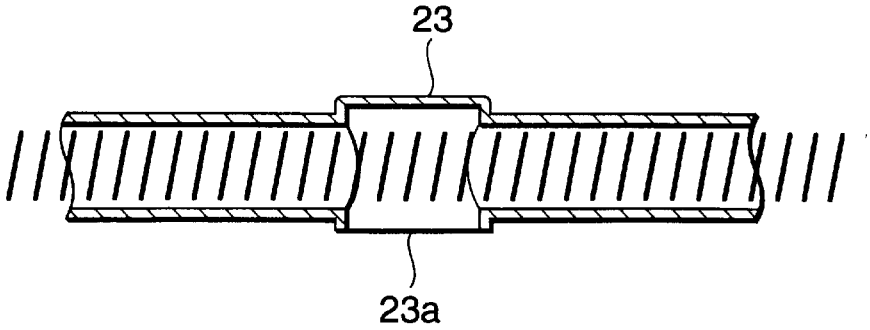
FIG. 7 is a cross section view of the toner transporting passage including the toner exhausting section.

On the upper portion of the developing unit 5, there is provided a toner hopper 21 that stores toner therein in order to resupply toner in accordance with consumption of the toner in the developing unit. The cleaning device 20 and the toner hopper 21 are connected to each other by a toner transporting passage 22, as shown in FIG. 2, and the toner recovered by the cleaning device 20 is returned through the toner transporting passage 22 to the toner hopper 21 side. The toner transporting passage 22 comprises, as shown in FIGS. 5 to 7, a hollow member 22*a* such as a cylindrical tube and an auger screw 22*b* passing through the hollow member 22*a*. By rotating the auger screw 22*b*, the toner is transported.

Figure 3:
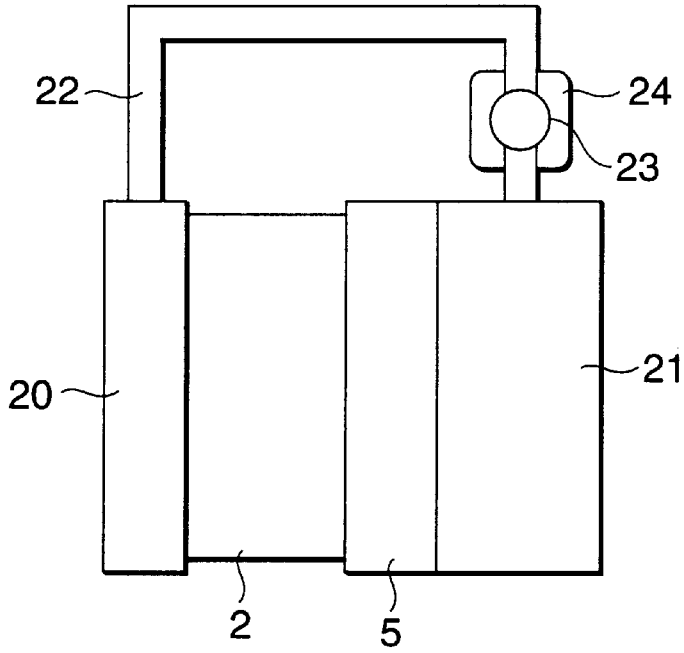
FIG. 3 is a schematic plan view showing the relationship among the cleaning device, the toner transporting passage and the toner hopper.
Figure 4:
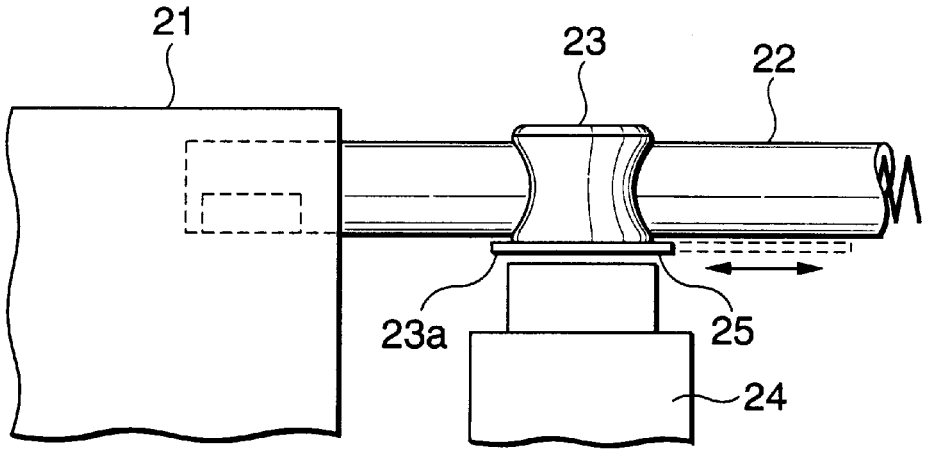
FIG. 4 is a schematic constitutional view showing the components near a toner exhausting section.

FIG. 3 is a diagram when FIG. 2 is viewed from the upper portion. At a part of the toner transporting passage 22, there is provided a toner exhausting section 23 for exhausting the toner returned from the cleaning device 20 outside the toner transporting passage 22. Reference numeral 24 is a toner container arranged below the toner exhausting section 23. The toner exhausting section 23 has a toner exhausting port 23*a* as shown in FIG. 4. When an opening and closing member 25 is closed with respect to the toner exhausting port 23*a* at a position shown by a solid line, the toner transported in the toner transporting passage 22 is returned to the toner hopper 21. When the opening and closing member 25 is opened with respect to the toner exhausting port 23*a* at a position shown by a broken line, the toner transported in the toner transporting passage 22 is thrown away into the toner container 24.

FIG. 5 is a perspective view in which the vicinity of the toner exhausting section is viewed from the lower portion, FIG. 6 is a horizontal sectional view of the toner transporting passage including the toner exhausting section, and FIG. 7 is a cross sectional view of the toner transporting passage including the toner exhausting section. As clear from FIG. 6, the invention is characterized in that an inner diameter D of the toner exhausting port 23*a* is made larger than an inner diameter d of the toner transporting passage before and after the toner exhausting port 23*a*.

Under the above structure, when the opening and closing member 25 is opened to open the toner exhausting port 23*a*, the waste toner is thrown away from the toner exhausting port 23*a* into the toner container 24 smoothly and reliably. Therefore, it is possible to prevent the toner from getting over the toner exhausting port 23*a* and returning to the toner hopper 21.

In the embodiment, as the hollow member 22*a* composing the toner transporting passage 22, a resin tube made of polypropylene is used, in which the toner transporting passage 22 and the toner exhausting section 23 are integrally formed. However, the material of the hollow member of the sectional shape of the toner transporting passage is not limited to that in this embodiment. Further, the toner transporting passage 22 and the toner exhausting section 23 do not always need to be formed integrally, but they may be provided individually and the hollow members may be respectively connected before and after the toner exhausting section.

Concerning the relationship between the inner diameter D of the toner exhausting port and the inner diameter d of the toner transporting passage, in the embodiment, the inner diameter D is set at about 30 mm and the inner diameter d is set at about 20 mm. It has been confirmed that the toner does not get over the toner exhausting port 23*a* and is caused not to return to the toner hopper 21 when the auger screw 22*b* in the toner transporting passage is rotated at about 140 rpm. To make the inner diameter of the toner exhausting part larger than that of the toner transporting passage produces an effect in recovery of the waste toner into the toner container as described above. However, when the inner diameter of the toner exhausting port is made too large, in case that the toner is intendedly returned to the toner hopper, the toner is stagnant at the toner exhausting port, so that a problem in toner transportation occurs. In view of the above points, the inner diameter D of the toner exhausting port and the inner diameter d of the toner transporting passage must be set suitably.

As described above, according to the invention, it is possible to realize an image forming apparatus capable of reliably exhausting waste toner from a toner exhausting port without returning the waste toner from the toner exhausting port to a toner hopper.

What is claimed is:

1. An image forming apparatus comprising:

a developing unit having a photoreceptor, the developing unit for making an electrostatic latent image on a surface of the photoreceptor visible as a toner image;

a toner hopper for storing toner to be supplied to the developing unit;

a cleaning device for removing and recovering the toner remained on the surface of the photoreceptor after the toner image has been transferred onto a recording material;

a toner transporting passage connected between the cleaning device and the toner hopper, through which the toner recovered by the cleaning device is returned to the toner hopper;

a toner exhausting port disposed at a part of the toner transporting passage, from which the toner being returned from the cleaning device side is exhausted outside the toner transporting passage; and an opening and closing member which selectively opens or closes the toner exhausting port, wherein an inner diameter of the toner exhausting port is made larger than that of the toner transporting passage.

2. The image forming apparatus as claimed in claim 1, further comprising a toner container detachably from the toner exhausting port, the toner container for storing the toner exhausted from the toner exhausting port.

3. The image forming apparatus as claimed in claim 1, wherein a tube forms the toner transporting passage, and the tube has a hollow portion through which the toner passes.

4. The image forming apparatus as claimed in claim 1, wherein the tube comprises a spiral member disposed in the hollow portion, and the spiral member rotates to move the toner from the cleaning device to the toner hopper.

5. The image forming apparatus as claimed in claim 4, wherein the inner diameter of the toner exhausting port is about 30 mm and the inner diameter of the tube is about 20 mm.

6. The image forming apparatus as claimed in claim 4, wherein the spiral member rotates at about 140 rpm.

7. The image forming apparatus as claimed in claim 3, wherein the tube is made of resin.

* * * * *